US009982214B2

(12) United States Patent
Shrestha et al.

(10) Patent No.: US 9,982,214 B2
(45) Date of Patent: May 29, 2018

(54) TRACTOR HYDRAULIC FLUID COMPOSITIONS

(71) Applicant: Chevron Oronite Company LLC, San Ramon, CA (US)

(72) Inventors: Kedar Shrestha, Shizuoka (JP); Shuhei Yamamoto, Shizuoka (JP)

(73) Assignee: Chevron Oronite Company LLC, San Ramon, CA (US)

( * ) Notice: Subject to any disclaimer, the term of this patent is extended or adjusted under 35 U.S.C. 154(b) by 157 days.

(21) Appl. No.: 14/181,538

(22) Filed: Feb. 14, 2014

(65) Prior Publication Data

US 2015/0232780 A1 Aug. 20, 2015

(51) Int. Cl.

| | |
|---|---|
| ***C10M 169/04*** | (2006.01) |
| ***C10M 163/00*** | (2006.01) |
| ***C10M 129/08*** | (2006.01) |
| ***C10M 135/10*** | (2006.01) |
| ***C10M 137/10*** | (2006.01) |

(52) U.S. Cl.

CPC ..... *C10M 163/00* (2013.01); *C10M 129/08* (2013.01); *C10M 135/10* (2013.01); *C10M 137/10* (2013.01); *C10M 169/04* (2013.01); *C10M 2207/022* (2013.01); *C10M 2215/08* (2013.01); *C10M 2219/0466* (2013.01); *C10M 2219/088* (2013.01); *C10M 2219/089* (2013.01); *C10M 2223/045* (2013.01); *C10N 2230/06* (2013.01); *C10N 2230/40* (2013.01); *C10N 2230/52* (2013.01); *C10N 2230/76* (2013.01); *C10N 2240/08* (2013.01)

(58) Field of Classification Search

CPC ..... C10M 129/08; C10M 135/10; C10M 137/10; C10M 2207/22; C10M 2219/0466; C10M 2223/045; C10M 169/04

See application file for complete search history.

(56) References Cited

U.S. PATENT DOCUMENTS

| | | | | |
|---|---|---|---|---|
| 4,331,222 | A * | 5/1982 | Liston | C10M 129/08 188/264 B |
| 4,406,803 | A | 9/1983 | Liston et al. | |
| 5,851,962 | A | 12/1998 | Kaga et al. | |
| 2008/0119378 | A1 * | 5/2008 | Gandon | C10M 159/24 508/390 |
| 2012/0165235 | A1 | 6/2012 | Li et al. | |
| 2013/0157908 | A1 | 6/2013 | Li et al. | |

FOREIGN PATENT DOCUMENTS

| | | |
|---|---|---|
| JP | 2000-017283 | 1/2000 |
| JP | 2000-273481 | 10/2000 |
| JP | 2010-121063 | 6/2010 |
| WO | 2010115864 | 10/2010 |
| WO | 2011007643 | 1/2011 |

OTHER PUBLICATIONS

Ichikawa et al., "Development of High Performance Transmission/Hydraulic Fluid (Kubota Super-UDT) Establishing the Specification and New Test Method," SAE International (1997).

* cited by examiner

*Primary Examiner* — Taiwo Oladapo
(74) *Attorney, Agent, or Firm* — Carlton Virassammy

(57) ABSTRACT

Lubricating oil compositions comprising neutral or low overbased alkaryl sulfonate calcium salts, hydrocarbyl polyalcohol, and zinc dialkyl dithiophosphate for use as tractor hydraulic fluids.

14 Claims, No Drawings

TRACTOR HYDRAULIC FLUID COMPOSITIONS

FIELD

Provided herein are tractor hydraulic fluid compositions comprising neutral or low overbased alkaryl sulfonate calcium salts, hydrocarbyl polyalcohol, and zinc dialkyl dithiophosphate for use, e.g., in agricultural machines.

BACKGROUND

Tractor hydraulic fluid compositions are formulated to exacting and often stringent specifications set by equipment manufacturers or governmental regulations. Depending on the application, the compositions may contain dispersants, detergents, anti-oxidants, wear inhibitors, rust inhibitors, corrosion inhibitors, foam inhibitors, friction modifiers, and/or other additives, together with base oils of lubricating viscosity.

Tractor hydraulic fluids are all-purpose products used for lubricant applications in a tractor, including but not limited to lubrication of gearboxes, power take-off and clutches, rear axles, reduction gears, wet brakes, and hydraulic accessories. The components included within a tractor fluid must be carefully chosen so that the final resulting fluid composition provides all the necessary characteristics required for the particular application. Such characteristics may include the ability to provide proper frictional properties that prevent wet brake chatter of oil immersed brakes while simultaneously providing the ability to actuate wet brakes and provide power take-off (PTO) clutch performance. Tractor hydraulic fluids are used, e.g., in agricultural machines, e.g., for lubricating hydraulic pumps, transmissions, clutches, gears, and wet brakes. Agricultural machines are frequently operated in settings where water is present, e.g., rice paddies and humid climates. As such, lubricating oil compositions for agricultural machines must be formulated to provide the desirable lubricating properties while at the same time minimizing the impact of water contamination, e.g., brake chattering and brake noise.

Thus, there is a need for tractor hydraulic fluid compositions that provide desirable friction properties while preventing or minimizing the negative impacts of water contamination, e.g., brake noise.

SUMMARY

Provided herein are tractor hydraulic fluid compositions comprising:

(a) a major amount of an oil of lubricating viscosity;

(b) a detergent composition comprising (i) at least one neutral or low overbased alkaryl sulfonate calcium salt, wherein the alkaryl group is an aryl group substituted with an alkyl group derived from propylene or isobutylene oligomers; and (ii) at least one neutral or low overbased alkaryl sulfonate calcium salt, wherein the alkaryl group is an aryl group substituted with an alkyl group derived from at least one normal alpha olefin or an isomerized normal alpha olefin, said olefin having from about 18 to about 30 carbon atoms;

(c) at least one hydrocarbyl polyalcohol, wherein the at least one hydrocarbyl polyalcohol is (i) 0.01 to 5 weight percent of the tractor hydraulic fluid composition and (ii) not glycerol; and (d) at least one zinc dialkyl dithiophosphate having secondary alkyl groups;

wherein the phosphorus content from the at least one zinc dialkyl dithiophosphate having secondary alkyl groups is at least 30 weight percent of the phosphorus content derived from all zinc dialkyl dithiophosphate present in the tractor hydraulic fluid composition.

DETAILED DESCRIPTION

Definitions

As used herein, "hydrocarbyl" refers to groups containing hydrogen and carbon, e.g., alkyl, alkenyl, alkynyl, and aryl groups. Hydrocarbyl groups can by cyclic, acyclic, branched, or straight-chained groups.

As used herein, "alkyl" refers to a straight or branched hydrocarbon group containing carbon atoms. In some embodiments, the alkyl group contains at least 1, 5, 10, 15, 20, 25, 30, 50, 100, 500, 1000, or 2000 carbon atoms.

As used herein, "alkenyl" refers to a straight or branched hydrocarbon group containing at least 2 carbon atoms and one or more carbon-carbon double bonds. As used herein, "alkynyl" refers to a straight or branched hydrocarbon group containing at least 2 carbon atoms and one or more carbon-carbon triple bonds. In some embodiments, the alkenyl or alkynyl group contains at least 1, 5, 10, 15, 20, 25, 30, 50, 100, 500, 1000, or 2000 carbon atoms.

As used herein, "aryl" refers to an aromatic monocyclic or multicyclic hydrocarbon group having 6 or more carbon atoms. The aryl group is optionally substituted with one or more hydrocarbyl groups. In some embodiments, the aryl group has 6 to 14 carbon atoms. Aryl groups include, but are not limited to phenyl, naphthyl, and fluorenyl groups. An exemplary substituted aryl group includes, but is not limited to, a tolyl group.

As used herein, "alkaryl" refers to an aryl group substituted with one or more alkyl groups.

As used herein, "detergent composition" refers to a composition that is suitable to combine with and provide detergent properties to an oil or lubricant. The detergent compositions described herein are combined with an oil of lubricating viscosity to formulate a tractor hydraulic fluid. Furthermore, the detergent compositions described herein comprise (i) at least one neutral or low overbased alkaryl sulfonate calcium salt, wherein the alkaryl group is an aryl group substituted with an alkyl group derived from propylene or isobutylene oligomers; and (ii) at least one neutral or low overbased alkaryl sulfonate calcium salt, wherein the alkaryl group is an aryl group substituted with an alkyl group derived from at least one normal alpha olefin or an isomerized normal alpha olefin, said olefin having from about 18 to about 30 carbon atoms.

As used herein, "major amount" refers to an amount that is at least 50 weight percent of the tractor hydraulic fluid composition described herein. In some embodiments, the amount is at least 60, at least 70, at least 80, or at least 90 weight percent.

As used herein, "TBN" refers to "total base number" and is a measure of reserve alkalinity. In general terms, TBN is the neutralization capacity of one gram of a lubricating composition expressed as a number equal to the mg of potassium hydroxide providing the equivalent neutralization. Thus, a TBN of 10 means that one gram of the composition has a neutralization capacity equal to 10 mg of potassium hydroxide. The TBN of a sample can be determined by ASTM Test No. D2896, incorporated herein by reference in its entirety, or any other equivalent procedure.

The term "overbased" refers to salts wherein the metal counterion, e.g., calcium, present exceeds the stoichiometric amount. Overbased salts are said to have conversion levels in excess of 100% (i.e., they comprise more than 100% of the theoretical amount of metal needed to convert the acid to its "normal", "neutral" salt). The expression "metal ratio," often abbreviated as MR, designates the ratio of total chemical equivalents of metal in the overbased salt to chemical equivalents of the metal in a neutral salt according to known chemical reactivity and stoichiometry. Thus, in a normal or neutral salt, the metal ratio is one and in an overbased salt, MR, is greater than one.

The term "low overbased" refers to overbased salts having a total base number of less than 200.

The term "high overbased" refers to overbased salts having a total base number of 200 or greater.

Compositions

Provided herein are tractor hydraulic fluid compositions comprising:

(a) a major amount of an oil of lubricating viscosity;

(b) a detergent composition comprising (i) at least one neutral or low overbased alkaryl sulfonate calcium salt, wherein the alkaryl group is an aryl group substituted with an alkyl group derived from propylene or isobutylene oligomers; and (ii) at least one neutral or low overbased alkaryl sulfonate calcium salt, wherein the alkaryl group is an aryl group substituted with an alkyl group derived from at least one normal alpha olefin or an isomerized normal alpha olefin, said olefin having from about 18 to about 30 carbon atoms;

(c) at least one hydrocarbyl polyalcohol, wherein the at least one hydrocarbyl polyalcohol is (i) 0.01 to 5 weight percent of the tractor hydraulic fluid composition and (ii) not glycerol; and (d) at least one zinc dialkyl dithiophosphate having secondary alkyl groups;

wherein the phosphorus content from the at least one zinc dialkyl dithiophosphate having secondary alkyl groups is at least 30 weight percent of the phosphorus content derived from all zinc dialkyl dithiophosphate present in the tractor hydraulic fluid composition.

Neutral or Low Overbased Alkaryl Sulfonate Calcium Salts

The compositions described herein comprise a detergent composition containing two neural or low overbased alkaryl sulfonate salts, each of which having a specific chemical structure. In particular, the compositions comprise:

(i) at least one neutral or low overbased alkaryl sulfonate calcium salt wherein the alkaryl group is an aryl group substituted with an alkyl group derived from propylene or isobutylene oligomers; and (ii) at least one neutral or low overbased alkaryl sulfonate calcium salt, wherein the alkaryl group is an aryl group substituted with an alkyl group derived from at least one normal alpha olefin or an isomerized normal alpha olefin, said olefin having from about 18 to about 30 carbon atoms.

These neutral or low overbased alkaryl sulfonate calcium salts can serve, e.g., as detergents in the compositions described herein.

In some embodiments, the at least one neutral or low overbased alkaryl sulfonate calcium salt having an alkaryl group that is an aryl group substituted with an alkyl group derived from propylene or isobutylene oligomers has the following formula:

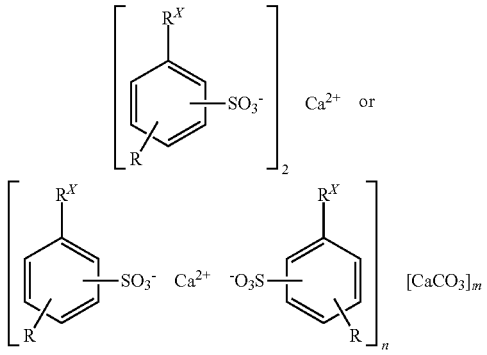

wherein R is an alkyl group derived from propylene or isobutylene oligomers;

$R^X$ is hydrogen or methyl, m is 0 to 5; and n is 1 or greater.

In some embodiments, m is 0.1-5. In some embodiments, n is 1. In some embodiments, the alkyl group has 3-36, 9-27, or 15-18 carbons. In some embodiments, the alkyl group is derived from propylene oligomers.

In some embodiments, the at least one neutral or low overbased alkaryl sulfonate calcium salt having an alkaryl group that is an aryl group substituted with an alkyl group derived from at least one normal alpha olefin or an isomerized normal alpha olefin, said olefin having from about 18 to about 30 carbon atoms, has the following structure:

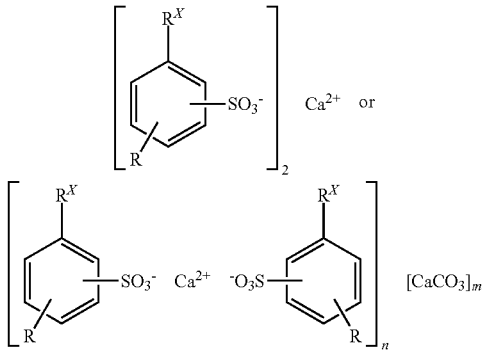

wherein R is an alkyl group derived from at least one normal alpha olefin or an isomerized normal alpha olefin, said olefin having from about 18 to about 30 carbon atoms;

$R^X$ is hydrogen or methyl, m is 0 to 5; and n is 1 or greater.

In some embodiments, m is 0.1-5. In some embodiments, n is 1.

In some embodiments, each of the neutral or low overbased alkaryl sulfonate calcium salts (i) or (ii) above is a neutral or low overbased alkyl-substituted benzene or neutral or low overbased alkyl-substituted toluene sulfonate calcium salt.

The calcium content accounted for by the at least one neutral or low overbased alkaryl sulfonate calcium salt having an alkaryl group that is an aryl group substituted with an alkyl group derived from propylene or isobutylene oligomers present in the oil composition is 0.001 to 0.4 weight percent of the oil composition. In some embodiments, the calcium content is 0.001 to 0.3, 0.001 to 0.2, 0.001 to 0.1, 0.001 to 0.05, 0.01 to 0.06, or 0.02 to 0.05 weight percent of the oil composition.

The calcium content accounted for by the at least one neutral or low overbased alkaryl sulfonate calcium salt having an alkaryl group that is an aryl group substituted with an alkyl group derived from at least one normal alpha olefin or an isomerized normal alpha olefin, said olefin having from about 18 to about 30 carbon atoms present in the oil composition is 0.001 to 0.4 weight percent of the oil composition. In some embodiments, the calcium content is 0.001 to 0.3, 0.001 to 0.2, 0.001 to 0.1, 0.001 to 0.05, 0.01 to 0.06, or 0.02 to 0.05 weight percent of the oil composition.

In some embodiments, the neutral or low overbased alkaryl sulfonate calcium salt (ii) is one wherein the alkaryl group is an aryl group substituted with an alkyl group derived from at least one normal alpha olefin or an isomerized normal alpha olefin, said olefin having from about 20 to about 24 carbon atoms.

In some embodiments, each or both of the alkaryl sulfonate calcium salts (i) or (ii) is neutral. In some embodiments, each or both of the alkaryl sulfonate calcium salts (i) or (ii) is low overbased, wherein the TBN is less than 200, less than 190, less than 180, less than 170, less than 160, less than 150, less than 140, less than 130, less than 120, less than 110, less than 100, less than 90, less than 80, less than 70, less than 60, less than 50, less than 40, less than 30, less than 20, or less than 10. In some embodiments, each or both of the alkyaryl sulfonate calcium salts (i) or (ii) has a TBN of 2-100, 2-80, or 2-60.

Hydrocarbyl Polyalcohol

The compositions described herein comprise at least one hydrocarbyl polyalcohol. In some embodiments, the hydrocarbyl polyalcohol have the formula $R(OH)_x$, wherein X is an integer from 2 to 6 and R is a hydrocarbyl group. In some embodiments, the hydrocarbyl polyalcohol is an alkyl polyalcohol or alkenyl polyalcohol. In some embodiments, the hydrocarbyl polyalcohol is a diol. In some embodiments, the diol is a 1,2-diol. In some embodiments, the hydrocarbyl group or the hydrocarbyl alcohol has 12 to 30, 14 to 20, or 16 to 18 carbon atoms.

In some embodiments, the hydrocarbyl polyalcohol is an alkane 1,2-diol or alkene 1,2-diol, wherein the hydrocarbyl polyalcohol has 12 to 30 carbon atoms. In certain embodiments, the hydrocarbyl polyalcohol has 14 to 20 carbon atoms. In some embodiments, the hydrocarbyl polyalcohol is 1,2-hexadecanediol or 1,2-octadecanediol.

In some embodiments, the compositions contain two or more hydrocarbyl polyalcohols.

The at least one hydrocarbyl polyalcohol is 0.01 to 5 weight percent of the oil composition. In some embodiments, the at least one hydrocarbyl polyalcohol is 0.01 to 4, 0.01 to 3, 0.01 to 2, 0.01 to 1, 0.1 to 1, 0.3 to 0.8, 0.4 to 0.7, or 0.5 weight percent of the oil composition.

In some embodiments, the oil composition does not contain glycerol.

Zinc Dialkyl Dithiophosphate Having Secondary Alkyl Groups

The compositions described herein comprise at least one zinc dialkyl dithiophosphate having secondary alkyl groups. These compounds can serve, e.g., as anti-wear agents in the compositions described herein. Zinc dialkyl dithiophosphates having secondary alkyl groups are known in the art. Exemplary methods for preparing zinc dialkyl dithiophosphates having secondary alkyl groups include reacting alcohols with phosphorus pentasulfide, then neutralizing the resultant intermediate with zinc oxide. In some embodiments, the zinc dialkyl dithiophosphate having secondary alkyl groups has the following structure:

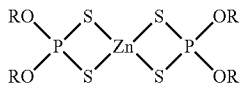

wherein R is a secondary alkyl group. In some embodiments, the zinc dialkyl dithiophosphate having secondary alkyl groups is derived from one or more secondary alcohols. Exemplary secondary alcohols include, but are not limited to 2 butanol or 4-methyl 2-pentanol. In some embodiments, the zinc dialkyl dithiophosphate having secondary alkyl groups include zinc di-isopropyl dithiophosphate, zinc di-sec-butyl dithiophosphate, zinc di-sec-penyl dithiophosphate, or zinc di-sec-hexyl dithiophosphate, or mixtures thereof.

The phosphorus content from the at least one zinc dialkyl dithiophosphate having secondary alkyl groups is at least 30 weight percent of the phosphorus content derived from all zinc dialkyl dithiophosphate present in the tractor hydraulic fluid composition. In some embodiments, the phosphorus content is at least 40, at least 50, at least 60, at least 70, at least 80, at least 90, or 100 weight percent.

Oil of Lubricating of Viscosity

Suitable oils of lubricating viscosity include, but are not limited to, base oils derived from mineral oils, synthetic oils or vegetable oils. In some embodiments, the oil has a viscosity of at least about 2.5 cSt at about 40° C. and a pour point below about 20° C., and in some embodiments, below 0° C. The base oils may be derived from synthetic or natural sources. Base oils may be derived from any of one or combination of Group I through Group V base stocks as defined in American Petroleum Institute Publication 1509, which is herein incorporated by reference. In some embodiments, mixtures of minerals are used, including mixtures of two Group 1 mineral oils. In some embodiments, the mixture is a mixture of a Group 1 mineral oil having a kinematic viscosity of 4.4 $mm^2/s$ at 100° C. and a Group 1 mineral oil having a kinematic viscosity of 7.3 $mm^2/s$ at 100° C.

Mineral oils for use as the base oil in this invention include, for example, paraffinic, naphthenic and other oils that are ordinarily used in lubricating oil compositions. Vegetable oils may include, for example, canola oil or soybean oil. Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Exemplary synthetic hydrocarbon oils include liquid polymers of alpha olefins having the proper viscosity. In some embodiments, the oil is a hydrogenated liquid oligomer of $C_6$ to $C_{12}$ alpha olefins such as 1-decene trimer. In some embodiments, alkyl benzenes of proper viscosity, such as didodecyl benzene, can be used. Exemplary synthetic esters include the esters of monocarboxylic acids and polycarboxylic acids, as well as mono-hydroxy alkanols and polyols. Examples also include, but are not limited to didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Exemplary oils also include blends of mineral oils with synthetic oils.

Other Additives

The compositions described herein, in some embodiments, comprise additional additive components, such as dispersants, anti-oxidants, rust inhibitors, viscosity index improvers, demulsifiers, pour point depressants, foam inhibitors, metal deactivators, and multifunctional additives.

1. Dispersants

Exemplary dispersants include, but are not limited to nitrogen-containing dispersants. In certain embodiments, the nitrogen content accounted for by all of the nitrogen dispersant(s) present in the oil composition is 0.01 to 1.0 weight percent of the oil composition. Exemplary dispersants also include, but are not limited to, alkenyl succinimides, alkenyl succinimides modified with other organic compounds, alkenyl succinimides modified by post-treatment with ethylene carbonate or boric acid, esters of polyalcohols and polyisobutenyl succinic anhydride, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

2. Anti-oxidants

Exemplary anti-oxidants include, but are not limited to phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butyl phenol), 4,4'-isopropylidene-bis(2,6-di-tert-bulylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butylphenol, 2,6-di-tert-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). In some embodiments, the phenolic oxidation inhibitor is pentaerythritol tetrakis(3-(3,5-di-tert-butyl-4-hydroxyphenyl)propionate), octadecyl 3-(3,5-di-tert-butyl-4-hydroxyphenyl)propionate, hexamethylene bis[3-(3,5-di-tert-butyl-4-hydroxyphenyl)propionate], thiodiethylene bis[3-(3,5-di-tert-butyl-4-hydroxyphenyl)propionate, or benzenepropanoic acid, 3,5-bis(1,1-dimethylethyl)-4-hydroxy-, $C_{7-9}$-branched alkyl ester. Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis(dibutyidithiocarbamate).

3. Rust Inhibitors

Exemplary rust inhibitors include, but are not limited to, nonionic polyoxyethylene surface active agents, polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate. Other compounds include stearic acid and other fatty acids, dicarboxylic acids, metal soaps, fatty acid amine salts, metal salts of heavy sulfonic acid, partial carboxylic acid ester of polyhydric alcohol, and phosphoric ester.

4. Viscosity Index Improvers

Exemplary viscosity index improvers include, but are not limited to, polymethacrylate type polymers, ethylene-propylene copolymers, styrene-isoprene copolymers, hydrogenated styrene-isoprene copolymers, polyisobutylene, and dispersant type viscosity index improvers.

5. Demulsifiers

Exemplary demulsifiers include but are not limited to addition products of alkylphenol and ethylene oxide, polyoxyethylene alkyl ether, and polyoxyethylene sorbitan ester.

6. Pour Point Depressants

Exemplary pour point depressants include but are not limited to polymethyl methacrylate.

7. Foam Inhibitors

Exemplary foam inhibitors include but are not limited to alkyl methacrylate polymers and dimethyl silicone polymers.

8. Metal Deactivators

Exemplary metal deactivators include but are not limited to disalicylidene propylenediamine, triazole derivatives, mercaptobenzothiazoles, thiadiazole derivatives, and mercaptobenzimidazoles.

9. Multifunctional Additives

Exemplary multifunctional additives include, but are not limited to sulfurized oxymolybdenum dithiocarbamate, sulfurized oxymolybdenum organo phosphorodithioate, oxymolybdenum monoglyceride, oxymolybdenum diethylate amide, amine-molybdenum complex compounds, and sulfur-containing molybdenum complex compounds.

In some embodiments, the oil composition does not contain a dialkyl hydrogen phosphite. In some embodiments, the oil composition does not contain a phosphate ester having the formula $(RO)_2PH(O)$, wherein R is an alkyl group or alkenyl group.

10. High Overbased Sulfonate Alkaline Earth Metal Salt

The compositions described herein, in some embodiments, further comprise a high overbased alkaryl sulfonate alkaline earth metal salt. Such compounds have a TBN of 200 or greater. In some embodiments, the TBN is 200-600, or 200-500, or 200-450, or 200-400, or 200-350, or 200-300, or 200-250. In some embodiments, the alkaline earth metal is calcium or magnesium. In some embodiments, the high-overbased sulfonate alkaline earth metal salt is an alkaryl sulfonate alkaline earth metal salt.

11. Zinc Dialkyl Dithiophosphate Having Primary Alkyl Groups

In some embodiments, the compositions described herein comprise a zinc dialkyl dithiophosphate having primary alkyl groups. Exemplary compounds include but are not limited to zinc di-isobutyl dithiophosphate, zinc di-n-hexyl dithiophosphate, zinc di-n-octyl dithiophosphate, zinc di-2-ethylhexyl dithiophosphate, zinc di-n-decyl dithiophosphate, zinc di-n-dodecyl dithiophosphate, zinc di-isotridecyl dithiophosphate, or mixtures thereof.

In some embodiments, the oil composition does not contain a neutral or overbased alkaline earth metal phenate salt. In some embodiments, the oil composition does not contain a magnesium hydrocarbyl sulfonate.

EXAMPLES

Exemplary oil compositions were evaluated against comparative compositions using the SAE No. 2 Friction Test and Brake Noise Test. Four exemplary compositions (Ex 1-4) and seven comparative examples (Ref 1-7) were formulated from the concentrates and components listed below.

TABLE 1

Weight percentages of calcium from alkaryl sulfonate calcium salts, weight percentages of hydrocarbyl polyalcohol, and weight percentages of phosphorus from zinc dialkyl dithiophosphate compounds in exemplary and comparative compositions evaluated

| Component | Ex 1 | Ex 2 | Ex 3 | Ex 4 | Ref 1 | Ref 2 | Ref 3 | Ref 4 | Ref 5 | Ref 6 | Ref 7 |
|---|---|---|---|---|---|---|---|---|---|---|---|
| Calcium sulfonate A | 0.012 | 0.018 | 0.012 | 0.024 | — | 0.012 | 0.012 | — | 0.036 | 0.036 | — |
| Calcium sulfonate B | 0.024 | 0.018 | 0.036 | 0.012 | 0.036 | 0.024 | 0.024 | 0.03 | — | — | 0.036 |
| ZDTP A | 0.074 | 0.055 | 0.110 | 0.074 | 0.074 | 0.074 | 0.074 | 0.104 | 0.104 | — | — |
| ZDTP B | 0.037 | 0.055 | — | 0.037 | 0.037 | 0.037 | 0.037 | — | — | 0.111 | 0.111 |
| Polyalcohol A friction modifier | 0.5 | 0.5 | 0.5 | 0.5 | 0.5 | — | — | 0.5 | 0.5 | 0.5 | 0.5 |
| Oleamide friction modifier | — | — | — | — | — | — | 0.5 | — | — | — | — |

Calcium sulfonate A is a low overbased calcium sulfonate derived from alkyl-substituted benzene sulfonic acid derived from $C_{15}$-$C_{18}$ propylene oligomers. The compositions were formulated from a concentrate of the sulfonate having a TBN of 21 mgKOH/g, 2.6 wt % calcium content and 48 wt % diluent oil.

Calcium sulfonate B is a low overbased calcium sulfonate derived from alkyl-substituted toluene sulfonic acid derived from isomerized $C_{20}$-$C_{24}$ olefins. The compositions were formulated from a concentrate of the sulfonate having a TBN of 19 mg KOH/g, 2.35 wt % calcium content, and 46 wt % diluent oil.

Each composition contained 9 mM/Kg of low overbased calcium sulfonate detergent, except for Example 3 which contained 12 mM/Kg of low overbased calcium sulfonate detergent.

ZDTP A is a secondary zinc dialkyl dithiophosphate derived from a mixture containing 69 wt % 2-butanol and 31 wt % 4-methyl-2-pentanol. The compositions were formulated from a concentrate having a phosphorus content of 7.2 wt %, zinc content of 7.85 wt %, and 25 wt % diluent oil.

ZDTP B is a primary zinc dialkyl dithiophosphate derived from 2-ethyl-1-hexanol. The compostions were formulated from a concentrate having a phosphorus content of 7.28 wt %, zinc content of 8.59 wt %, and 8.5 wt % diluent oil.

Polyalcohol A friction modifier is a mixture of 1,2-hexadecanediol and 1,2-octadecanediol.

The exemplary and comparative compositions further comprised 60 mM/Kg of high overbased calcium sulfonate detergent, 0.2 wt. % of dispersant (except Reference examples 6 and 7 which did not have dispersant), 0.05 wt. % antioxidant, and foam inhibitor. Each composition was blended to a TBN of about 6 mgKOH/g.

SAE No. 2 Friction Test

The compositions described above were assessed using the SAE No. 2 Friction test under the following conditions:

Disk: Paper disk

Plate: Steel plate

Motor rotating speed: 2940 rpm

Applied pressure: 20 kg/cm$^2$

Lubricant Temperature: 80° C.

Measurements were carried out by taking the value of 1200 rpm as the dynamic friction coefficient ($\mu_d$) and the friction coefficient at the engaging point of the clutch as the break-away friction coefficient (μ0). The maximum friction coefficient at the engaging point at 0.7 rpm was measured as the static friction coefficient (μs).

The results are summarized in the Table 2 below:

TABLE 2

| Friction Property | Ex 1 | Ex 2 | Ex 3 | Ex 4 | Ref 1 | Ref 2 | Ref 3 | Ref 4 | Ref 5 | Ref 6 | Ref 7 |
|---|---|---|---|---|---|---|---|---|---|---|---|
| $\mu_d$ | 0.121 | 0.118 | 0.112 | 0.132 | 0.116 | 0.124 | 0.120 | 0.103 | 0.104 | 0.117 | 0.116 |
| $\mu_s$ | 0.120 | 0.123 | 0.110 | 0.128 | 0.099 | 0.144 | 0.122 | 0.094 | 0.115 | 0.112 | 0.099 |
| $\mu_o/\mu_d$ | 1.050 | 1.085 | 1.018 | 1.076 | 0.966 | 1.100 | 1.090 | 1.019 | 1.144 | 1.034 | 0.966 |

Pass criteria: $\mu_d$: 0.10 min; $\mu_s$ 0.11 min; $\mu_o/\mu_d$:1.1 max

Brake Noise Test

A tractor was operated in low gear (low-I gear, low-II gear, and low-III gear) at 1200-1800 rpm with straight double brake, straight alternating brake, and turn single brake applications. Noise level was determined by ear as "no noise", "noise", and "heavy noise." Initially, the tractor with new test oil is tested at 0% vol water. Water is then added by the amount of 0.1 vol. %, and the tractor is tested the driving/braking conditions. The cycle is repeated until brake noise occurs or water contamination becomes 0.2 vol. %.

The results are summarized in Table 3 below:

TABLE 3

| Water Content | Ex 1 | Ex 2 | Ex 3 | Ex 4 | Ref 1 | Ref 2 | Ref 3 | Ref 4 | Ref 5 | Ref 6 | Ref 7 |
|---|---|---|---|---|---|---|---|---|---|---|---|
| 0 | No noise | No noise | No noise | No noise | No noise | Noise | No noise | No noise | No noise | No noise | Not run |
| 0.1 vol % | No noise | No noise | No noise | No noise | No noise | Noise | Noise | No noise | No noise | Noise | Not run |
| 0.2 vol % | No noise | Noise | No noise | Noise | Noise | Noise | Noise | No noise | Noise | Noise | Not run |

Pass criterion: no noise at 0.1 vol % water min

As shown in Table 2, all of the exemplary compositions (Ex 1-4) satisfied pass criteria for all assessed friction properties in the SAE No. 2 Friction Test, i.e., $\mu_d$, $\mu_s$, and $\mu_o/\mu_d$. Furthermore, the exemplary compositions (Ex 1-4) exhibited friction properties comparable to those of Ref examples 2, 3 and 6 and superior to Ref examples 1, 4, 5 and 7.

As shown in Table 3, all of the exemplary compositions (Ex 1-4) satisfied the pass criterion of the Brake Noise Test. The exemplary compositions exhibited anti-noise properties even when contaminated with 0.1 vol % water, in contrast to Ref examples 2, 3 and 6.

In contrast to the comparative examples (Ref 1-7), the exemplary compositions satisfied all pass criteria for both the SAE No. 2 Friction Test and the Brake Noise Test. Industry standards frequently require tractor hydraulic fluid compositions to provide superior friction properties while at the same time the ability to prevent or minimize the negative impacts of water contamination, e.g., brake noise. The exemplary compositions demonstrate passing both the SAE No. 2 Friction Test and Brake Noise test.

The embodiments of the invention described above are intended to be merely exemplary, and those skilled in the art will recognize, or will be able to ascertain using no more than routine experimentation, numerous equivalents of specific compounds, materials, and procedures. All such equivalents are considered to be within the scope of the invention and are encompassed by the appended claims.

All of the patents, patent applications and publications referred to herein are incorporated herein in their entireties. Citation or identification of any reference in this application is not an admission that such reference is available as prior art to this invention. The full scope of the invention is better understood with reference to the appended claims.

What is claimed is:

1. A tractor hydraulic fluid composition comprising:

(a) a major amount of an oil of lubricating viscosity;

(b) a detergent composition comprising (i) at least one low overbased alkaryl sulfonate calcium salt, wherein the alkaryl group is an aryl group substituted with an alkyl group derived from propylene or isobutylene oligomers, said oligomers having from about 15 to about 18 carbon atoms, wherein the calcium content of all of the at least one low overbased alkaryl sulfonate calcium salt having an alkaryl group that is an aryl group substituted with an alkyl group derived from propylene or isobutylene oligomers present in the oil composition is 0.01 to 0.06 weight percent of the tractor hydraulic fluid composition; and (ii) at least one low overbased alkaryl sulfonate calcium salt, wherein the alkaryl group is an aryl group substituted with an alkyl group derived from at least one normal alpha olefin or an isomerized normal alpha olefin, said olefin having from about 20 to about 24 carbon atoms, wherein the calcium content of all of the at least one low overbased alkaryl sulfonate calcium salt having an alkaryl group that is an aryl group substituted with an alkyl group derived from at least one normal alpha olefin or an isomerized normal alpha olefin is 0.01 to 0.06 weight percent of the tractor hydraulic fluid composition;

(c) at least one hydrocarbyl polyalcohol, wherein the at least one hydrocarbyl polyalcohol is (a) 0.5 to 1.0 weight percent of the tractor hydraulic fluid composition and (b) not glycerol; and (d) at least one secondary zinc dialkyl dithiophosphate having secondary alkyl groups;

wherein the total phosphorus provided by the at least one zinc dialkyl dithiophosphate having secondary alkyl groups is from 0.055 to 0.110 weight percent in the tractor hydraulic fluid composition, and wherein the zinc dialkyl dithiophosphate having secondary alkyl groups provides from 50 to 100 weight percent of the phosphorus content provided by all zinc dialkyl dithiophosphate present in the tractor hydraulic fluid composition.

2. The tractor hydraulic fluid composition of claim 1, wherein the alkaryl group of the at least one low overbased alkaryl sulfonate calcium salt of (b)(i) or (b)(ii) is an alkyl-substituted benzene group or alkyl-substituted tolyl group.

3. The tractor hydraulic fluid composition of claim 1, wherein each of the at least one alkaryl sulfonate calcium salts of (b)(i) and (b)(ii) is a low overbased salt having a total base number of less than 90.

4. The tractor hydraulic fluid composition of claim 1, wherein the total base number is 2 to 60.

5. The tractor hydraulic fluid composition of claim 1, wherein the alkyl group of the at least one alkaryl sulfonate calcium salts of (b)(i) is derived from propylene oligomers.

6. The tractor hydraulic fluid composition of claim 1, wherein the at least one hydrocarbyl polyalcohol is an alkane 1,2-diol or alkene 1,2-diol.

7. The tractor hydraulic fluid composition of claim 1, wherein the hydrocarbyl polyalcohol has 12 to 30 carbon atoms.

8. The tractor hydraulic fluid composition of claim 1, wherein the tractor hydraulic fluid composition further comprises at least one nitrogen-containing dispersant, wherein the nitrogen of all of the at least one nitrogen dispersant present in the oil composition is 0.01 to 1.0 weight percent of the tractor hydraulic fluid composition.

9. The tractor hydraulic fluid composition of claim 1, wherein the tractor hydraulic fluid composition further comprises a high overbased alkaryl sulfonate alkaline earth metal salt.

10. The tractor hydraulic fluid composition of claim 1, wherein the tractor hydraulic fluid composition does not contain a neutral or overbased alkali earth metal phenate salt.

11. The tractor hydraulic fluid composition of claim 1, wherein the tractor hydraulic fluid composition does not contain a magnesium hydrocarbyl sulfonate.

12. The tractor hydraulic fluid composition of claim 1, wherein the tractor hydraulic fluid composition does not contain a dialkyl hydrogen phosphite.

13. The tractor hydraulic fluid composition of claim 1, wherein the tractor hydraulic fluid composition further comprises a zinc dialkyl dithiophosphate having primary alkyl groups.

14. The tractor hydraulic fluid composition of claim 1, wherein the tractor hydraulic fluid further comprises an anti-oxidant.

* * * * *